US007814596B2

(12) United States Patent
Do et al.

(10) Patent No.: US 7,814,596 B2
(45) Date of Patent: Oct. 19, 2010

(54) METHOD FOR CONTROLLING WASHING MACHINE

(75) Inventors: Gi Hyeong Do, Changwon-si (KR); Jung Hoon Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 563 days.

(21) Appl. No.: 10/563,001

(22) PCT Filed: Oct. 19, 2005

(86) PCT No.: PCT/KR2005/003475

§ 371 (c)(1),
(2), (4) Date: Feb. 9, 2007

(87) PCT Pub. No.: WO2006/043775

PCT Pub. Date: Apr. 27, 2006

(65) Prior Publication Data

US 2008/0120788 A1 May 29, 2008

(30) Foreign Application Priority Data

Oct. 21, 2004 (KR) ..... 10-2004-0084508

(51) Int. Cl.
*D06F 33/02* (2006.01)
*D06F 39/08* (2006.01)
*D06F 35/00* (2006.01)

(52) U.S. Cl. ..... 8/159; 8/158

(58) Field of Classification Search ..... 8/158, 8/159; 68/12.04
See application file for complete search history.

(56) References Cited

U.S. PATENT DOCUMENTS

| | | | | |
|---|---|---|---|---|
| 4,791,691 | A * | 12/1988 | Fukuzawa et al. | 8/159 |
| 5,507,053 | A | 4/1996 | Mueller et al. | |
| 2004/0144136 | A1 * | 7/2004 | Mae et al. | 68/12.19 |
| 2004/0172985 | A1 * | 9/2004 | Mamiya et al. | 68/12.05 |
| 2004/0255391 | A1 * | 12/2004 | Kim et al. | 8/149.3 |
| 2007/0169280 | A1 | 7/2007 | Kim et al. | |

FOREIGN PATENT DOCUMENTS

| | | | |
|---|---|---|---|
| CN | 86102794 | A | 11/1986 |
| CN | 1537995 | A | 10/2004 |
| EP | 1 375 728 | A1 | 1/2004 |
| KR | 10-2004-0088884 | A | 10/2004 |

* cited by examiner

*Primary Examiner*—Joseph L Perrin
(74) *Attorney, Agent, or Firm*—Birch, Stewart, Kolasch & Birch, LLP

(57) ABSTRACT

The present invention discloses a method for controlling a washing machine for shortening a washing time period and extending lifetimes of components of the washing machine. For this, the present invention provides a method for controlling a washing machine including the steps of sensing a laundry amount, repeatedly supplying washing water to a tub of the washing machine with reference to the laundry amount sensed thus, and circulating the washing water for a predetermined time period for wetting the laundry, wherein the step of circulating is performed only once.

11 Claims, 9 Drawing Sheets

METHOD FOR CONTROLLING WASHING MACHINE

TECHNICAL FIELD

The present invention relates to a method for controlling a drum type washing machine, and more particularly, to a method for controlling supply and circulation of washing water.

BACKGROUND ART

The drum type washing machine washes laundry through cycles of washing, rinsing, and spinning for removing dirt from clothes, and beddings introduced into a drum by using action of washing water held in a tub.

In general, the washing machine performs preliminary steps for adequate soaking of the laundry before actual washing. In more detail, the washing water is provided to an inside of the drum that holds the laundry, and the washing water circulates between the tub on an outside of the drum and the drum for better soaking of the laundry, which step is repeated for a few times.

However, such a related art method for controlling a washing machine shortens lifetimes of related components due to frequent washing water supply and circulation, and impairs reliability. Moreover, the related art method for controlling a washing machine elongates a total washing time period due to the frequent washing water supply and circulation.

DISCLOSURE

Technical Problem

The object of the present invention, designed for solving the problems of the related art, lies on providing a method for controlling a washing machine, which can shorten a total washing time period, and can improve lifetimes and reliability of components required for circulation of the washing water.

Technical Solution

In one aspect of the present invention, the object of the present invention can be achieved by providing a method for controlling a washing machine including the steps of sensing a laundry amount, repeatedly supplying washing water to a tub of the washing machine with reference to the laundry amount sensed thus, and circulating the washing water for a predetermined time period for wetting the laundry, wherein the step of circulating is performed only once.

The step of circulating is performed after all the step of supplying is finished.

In this case, the method further includes the step of determining a quantity of washing water to be supplied in the step of supplying according to the laundry amount before the step of supplying. The step of determining a quantity includes the step of setting a total time period of the step of supplying.

Moreover, the method further includes the step of setting a time period of the step of circulating washing water according to the laundry quantity at least before the step of circulating washing water.

The step of circulating washing water includes the step of positioning the washing water at the tub and an inside of the tub, and circulating the washing water between the tub and the inside of the tub and a drum.

In the meantime, the step of circulating washing water is performed after a step of initial supply of washing water is finished in the step of supplying washing water.

In this case, the method further includes the step of determining a quantity of washing water to be supplied during the step of initial supply of washing water according to the laundry amount sensed before the step of supplying washing water.

The step of determining a quantity of washing water includes the step of setting a total time period of the step of initial supply of washing water, or the step of setting a water level to be reached in the step of initial supply of washing water.

The method may further include the step of rotating the drum of the washing machine in the middle of the step of supplying washing water. Moreover, the method may further include the step of rotating the drum of the washing machine after finish of the step of supplying washing water. Preferably, the method may further include the step of rotating the drum of the washing machine during the step of circulating washing water.

In the meantime, in another aspect of the present invention, a method for controlling a washing machine includes the steps of making an initial supply of washing water for a predetermined time period, circulating the washing water for a predetermined time period for wetting the laundry, and repeatedly supplying the washing water at regular intervals without the circulation of the washing water.

Preferably, the method further includes the step of rotating the drum of the washing machine during the step of circulating washing water. Or, the method may further include the step of rotating the drum of the washing machine in alternation with the step of supplying washing water.

The method further includes the step of rotating the drum of the washing machine after the step of supplying washing water.

Advantageous Effects

Owing to the present invention, a total washing time period can be shortened, and lifetimes of related components are extended, substantially.

DESCRIPTION OF DRAWINGS

The accompanying drawings, which are included to provide a further understanding of the invention, serve to explain the principle of the invention together with the description. In the drawings.

BEST MODE

Reference will now be made in detail to the preferred embodiments of the present invention, examples of which are illustrated in the accompanying drawings. Wherever possible, the same reference numbers will be used throughout the drawings to refer to the same or like parts.

Figure 1:
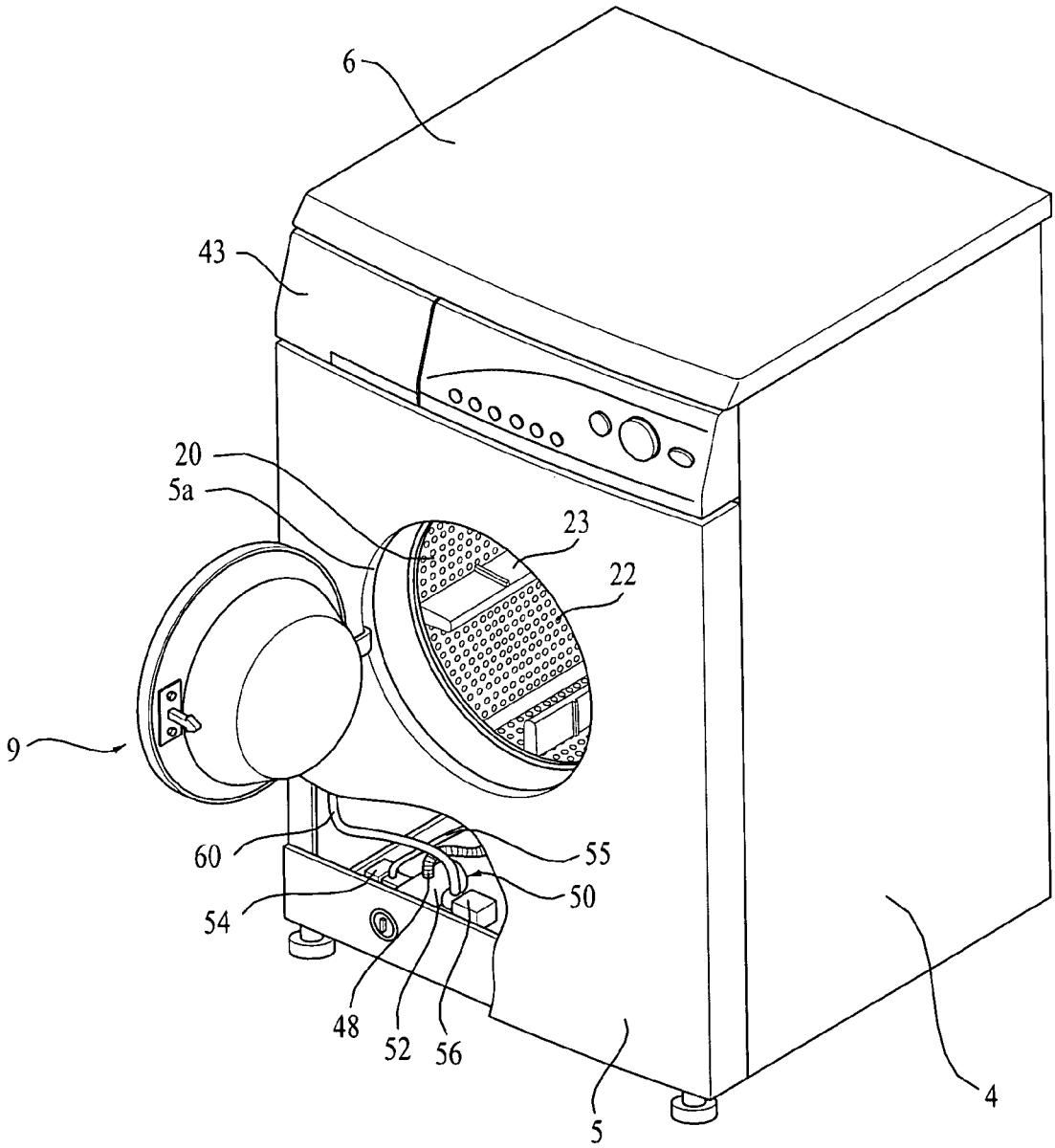
FIG. 1 illustrates a perspective view of a drum type washing machine in accordance with a preferred embodiment of the present invention.
Figure 2:
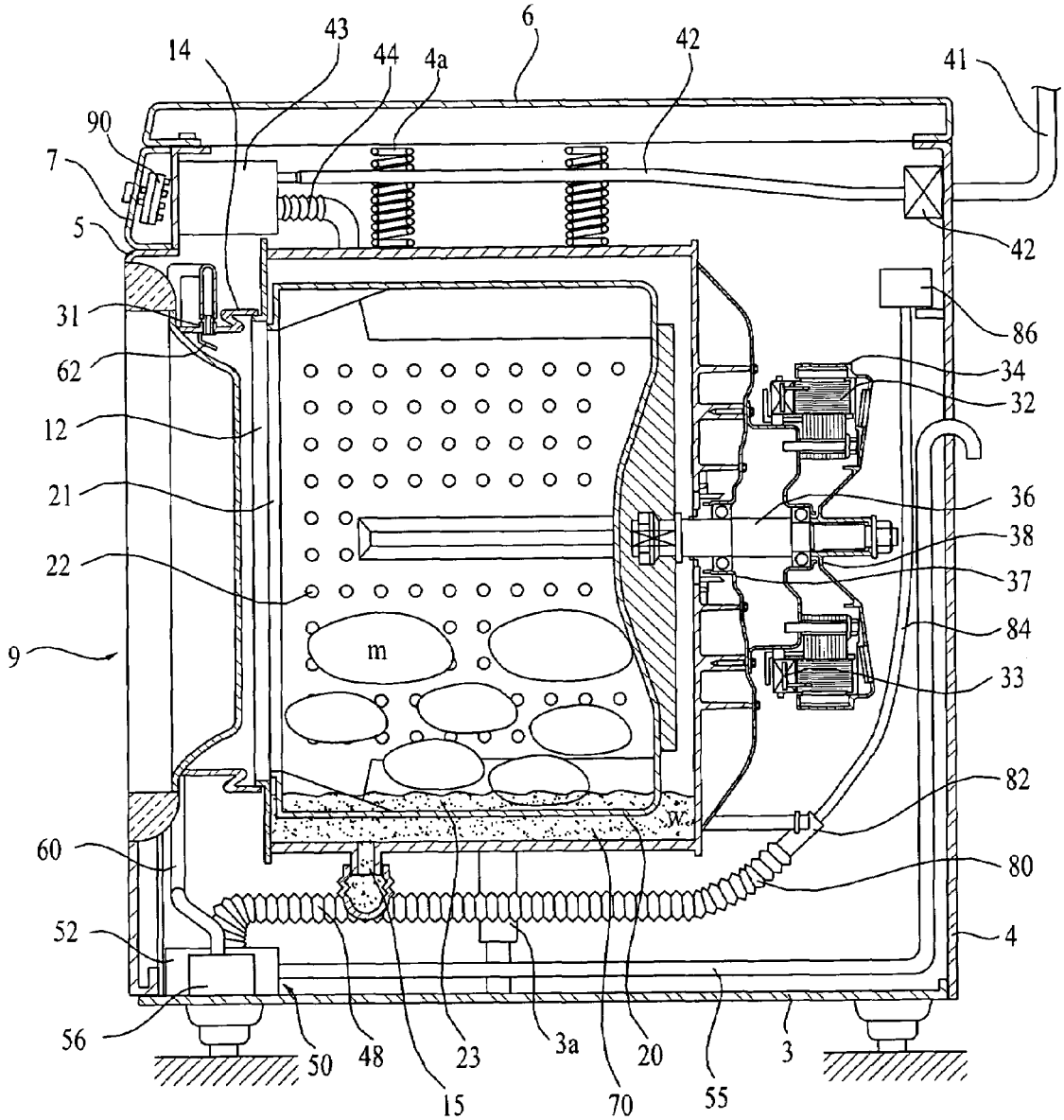
FIG. 2 illustrates a section of a drum type washing machine in accordance with a preferred embodiment of the present invention.

FIG. 1 illustrates a perspective view of a drum type washing machine in accordance with a preferred embodiment of the present invention, and FIG. 2 illustrates a section of a drum type washing machine in accordance with a preferred embodiment of the present invention.

Referring to FIGS. 1 and 2, the drum type washing machine includes a cabinet on a base 3, a cabinet cover 5 mounted on a front of the cabinet 4 having a laundry opening 5*a* formed therein, a door 9 rotatably mounted on the cabinet cover 5 for opening/closing the laundry opening 5*a*, a top plate 6 on an upper side of the cabinet 4, and a control panel 7 on the top plate 6 or at an upper portion of the cabinet cover 4 for user's selection of a cycle from washing, rinsing, or spinning.

Over the base 3, there is a tub 10 suspended with springs 3*a* and dampers 4*a* for holding washing water.

The tub 10 is a cylinder laid down on one side, has an opening 12 in rear of the laundry opening 5*a* in the cabinet cover 5, and a gasket 14 mounted on a front of a circumference of the opening 12, with a sealing portion to be brought into close contact with the door 9.

Inside of the tub 10, there is a drum 20 spaced from an inside surface of the tub 10 for holding laundry.

The drum 20 is a cylinder laid down on one side, and has an opening 21 in a front for introduction of laundry 'm', a plurality of water holes 22 in a circumference or back for flowing in/out of the washing water, and lifters 23 on an inside circumferential surface for lifting/dropping the laundry 'm'.

Mounted on the tub 10, there is a motor 30 for supporting as well as rotating the drum 20.

The motor 30 includes a stator 32 mounted on a rear surface of the tub 10, a rotor 34 rotatable in interaction with the stator 32, and a rotating shaft 36 fixed to the rotor 32 for rotating with the rotor.

The stator 32 has a hole sensor 33 mounted thereon for measuring a rotation angle or RPM of the rotor 34.

The rotation shaft 36 is arranged to pass through a rear surface portion of the tub 10, and rotatably supported on bearings 37 and 38 mounted on the tub, and has a rear end fixed to the rotor 32, and a front end connected to a rear side of the drum 20.

Above the tub 10, there is a water supplying unit connected thereto for supplying washing water to an inside of the tub 10.

The water supply unit includes a water supply valve 41 connected to an external hose 40 for turning on/off clean water supplied through the external hose 40, a water supply hose 42 for guiding the water passed through the water supply valve 41, a detergent box 43 having a detergent holding space, a water supply passage, and an outlet for mixing the water supplied through the water supply hose 42 with the detergent stored therein in advance, and discharging the mixture, and a water supply bellows tube 44 having one end connected to the outlet of the detergent box 43 and the other end connected to a water supply opening in one side of an upper portion of the tub 10 for guiding the water containing the detergent from the detergent box 43, or clean water without the detergent contained therein (hereafter called as 'washing water') to the inside of the tub 10.

At a bottom of the tub 10, there is a drain hole 15 for draining the washing water, with a drain bellows tube 48 connected thereto for guiding the washing water from the drain hole 15.

Connected to the drain bellows tube 48, there is a pump unit 50 for pumping the water received from the tub 10 through the drain hole 15 and the drain bellows tube 48 to an outside of the washing machine, or circulating to an inside of the drum 20 again.

The pump unit 50 includes a filter case 52, a drain pump 54, and a circulating pump 56.

The filter case 52 has a connection hole connected to the drain bellows tube 48, a flow passage in communication both with the drain pump 54 and the circulating pump 56 for pass through of the washing water, and a filter (not shown) for filtering foreign matters, such as fluffs from the washing water.

The drain pump 54 has a drain hose 55 connected thereto and extended to an outside of the casing 2, for draining the water introduced to the pump case 52 in draining the drum type washing machine to an outside of the washing machine through the drain hose 55.

The circulating pump 56 has a circulating hose 60 connected thereto and extended to an upper side of the gasket 14 for pumping the water introduced into the filter case 52 in washing or rinsing of the drum type washing machine to the circulating hose 60.

The circulating hose 60 has one end arranged adjacent to the upper side of the gasket 14.

The circulating hose 60 has a sprayer 62 passed through an upper portion of the gasket 14, with a nozzle opened toward the inside of the drum 20, for spraying the guided washing water to the inside of the drum 20.

In the meantime, the drum type washing machine has a water level sensing unit for sensing a water level of the washing water supplied thereto.

The water level sensing unit includes a water level sensing bellows tube 80 connected to one side of the drain bellows tube 48, an air chamber 82 having a lower end connected to the water level bellows tube 80, filled with air for exerting a pressure according to a water level rising from the water level bellows tube 80, a water level sensing tube 84 having a lower end connected to one side of the air chamber 82, and a water level sensor 86 connected to an upper end of the water level sensing tube 84 for sensing an air pressure in the water level sensing tube 84, to sense a water level.

Unexplained reference numeral 90 denotes a control unit for operating the control panel 7, and controlling the motor 30, the water supply valve 42, the drain pump 54, and the circulating pump 56 according to the water level of the washing water sensed at the water level sensor 86, and RPM measured at the hole sensor 33.

A method for controlling a drum type washing machine of the present invention will be described, in detail.

Figure 3:
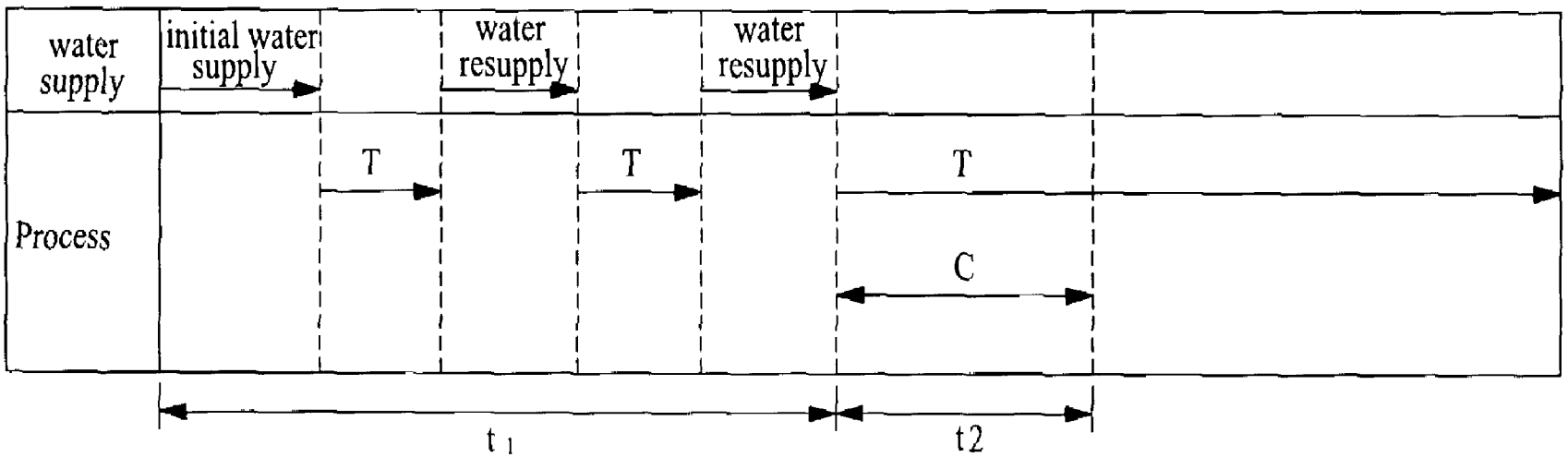
FIG. 3 illustrates a diagram showing washing water supply, drum rotation, and washing water circulation in a method for controlling a drum type washing machine in accordance with a first preferred embodiment of the present invention.
Figure 4:
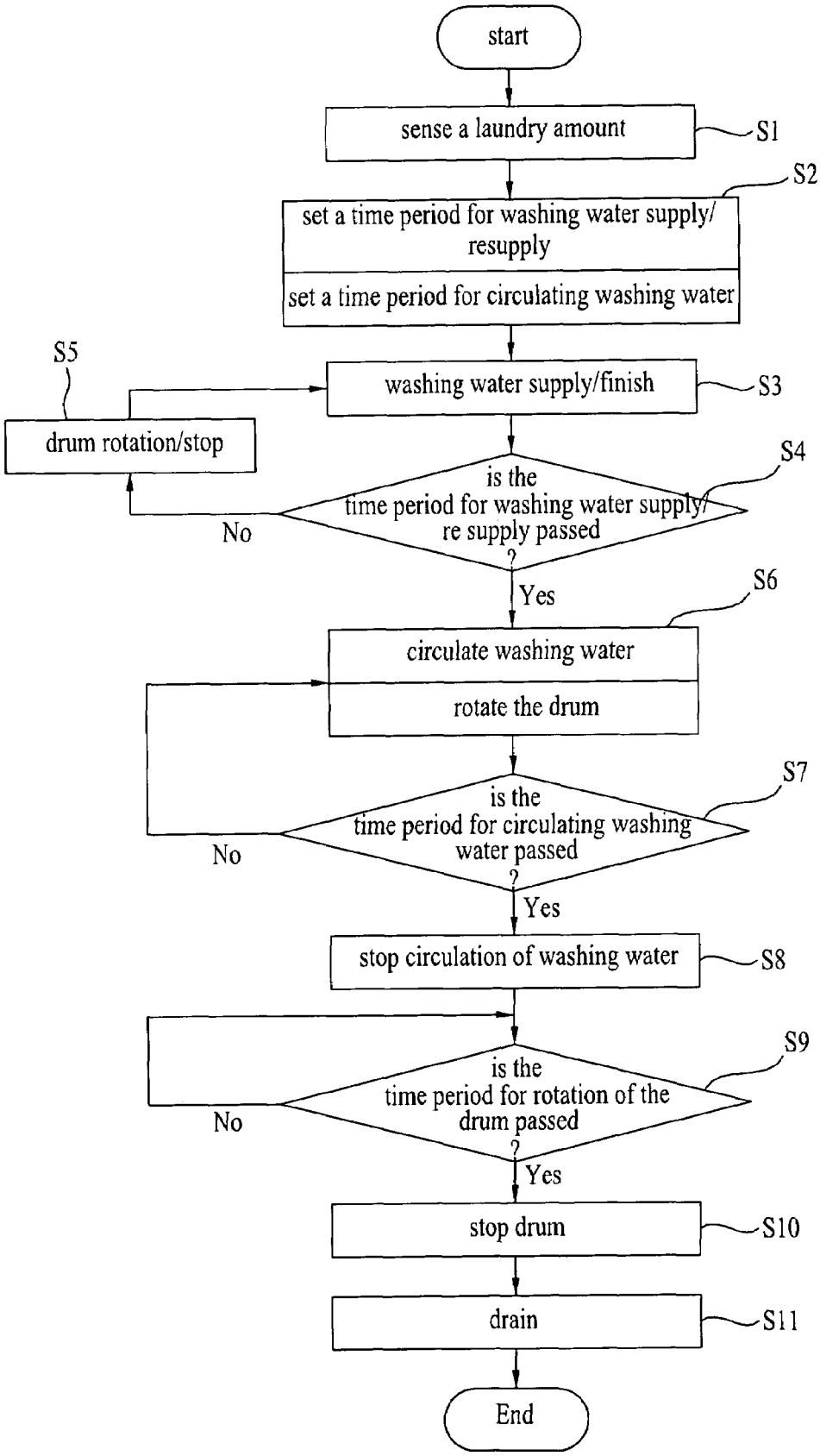
FIG. 4 illustrates a flow chart showing the steps of a method for controlling a drum type washing machine in accordance with a first preferred embodiment of the present invention.

FIG. 3 illustrates a diagram showing washing water supply, drum rotation, and washing water circulation in a method for controlling a drum type washing machine in accordance with a first preferred embodiment of the present invention, and FIG. 4 illustrates a flow chart showing the steps of a method for controlling a drum type washing machine in accordance with a first preferred embodiment of the present invention. In FIG. 3, a "T" denotes rotation of the drum, "C" denotes circulation of the washing water. Such a notation is applicable to the following FIGS. 5 and 9.

In the method for controlling a drum type washing machine in accordance with a preferred embodiment of the present invention, referring to FIG. 4, if an order to perform a washing cycle is received, the control unit 90 senses an amount of the laundry (S1).

The control unit 90 may sense the laundry amount by utilizing a time period the rotor 34 of the motor takes in one revolution, or by utilizing an angle of inertial rotation of the rotor 34 after rotating the rotor 34, or other methods except above. The following description is based on sensing of the laundry amount by utilizing the inertial rotation of the rotor 34 after rotating the rotor 34.

The control unit 90 starts and accelerates the motor 30, until RPM of the rotor 34 reaches to a reference RPM, when the control unit 90 maintains the rotor 34 to rotate at a constant speed for a preset time period, and measures a pulse width modulation (PWM) duty value from the starting to the maintenance of the constant speed.

Then, the control unit 90 turns off the motor 30 after the maintenance of the constant speed, measures a rotation angle of the inertial rotation, calculates the laundry amount by adding a value obtained by multiplying a coefficient to the PWM duty value measured thus to a value obtained by multiplying a coefficient to the rotation angle, and set the calculated laundry amount as the sensed laundry amount.

Then, the control unit 90 sets the water supply/water re-supply set time period '$t_1$' with reference to the sensed laundry amount, and sets a circulation set time period '$t_2$' with reference to the sensed laundry amount (S2).

That is, if the laundry amount is great, the control unit 90 sets the water supply/water re-supply set time period '$t_1$' to be long (for an example, 7 minutes), and the circulation set time period '$t_2$' to be long (for an example, 3 minutes) as well, and if the laundry amount is small, the control unit 90 sets the water supply/water re-supply set time period '$t_1$' to be short (for an example, 2 minutes), and the circulation set time period '$t_2$' to be long (for an example, 1 minutes) as well.

The water supply/water re-supply set time period '$t_1$', and the circulation set time period '$t_2$' may be set by using separate equations, or tables, or other methods except above.

Referring to FIG. 3, the control unit 90 performs water supply/water re-supply for the water supply/water re-supply set time period '$t_1$', and circulates the washing water only once for the circulating set time period '$t_2$'.

The washing water supply/re-supply and the one time circulation of the washing water will be described in more detail.

The control unit 90 turns on the water supply valve 42 for an initial water supply.

When the water supply valve 42 is turned on, the washing water is supplied to a lower side of the inside of the tub 10, and flows to the inside of the drum 20 through the water holes 22 in the drum 20, to wet the laundry 'm'.

In the meantime, if the water level of the washing water reaches to a preset water level '$h_1$', the water supply valve 42 is turned off, to stop the water supply (S3).

The preset water level '$h_1$' is set higher than a lower end of the drum 20 by a preset height such that the laundry 'm' in the drum 20 is wet with the washing water 'w'.

Then, the control unit 90 compares a time period after starting of the initial water supply and the water supply/water re-supply set time period '$t_1$' (S4).

The control unit 90 turns on the motor 30 to rotate the drum 20 if the time period after starting of the initial water supply is less than the water supply/water re-supply set time period '$t_1$' (S4).

When the drum 20 rotates, the laundry 'm' in the drum 20 moves within the drum 20 to wet with the washing water 'w', and to have dirt removed from the laundry owing to action of the washing water, and, while an amount of the washing water wetting the laundry becomes the greater as time goes by gradually, the water level of the washing water at the lower portion of the inside of the tub 20 becomes the lower, gradually.

The control unit 90 turns off the motor 30 if the motor 30 is driven for a preset time period (for an example, 30 seconds), or the water level of the washing water at the lower portion of the inside of the tub 20 is lower than a second set water level ($h_2$, $h_2<h_1$) (S5).

The control unit 90 turns on the water supply valve 42 again for re-supply of fresh washing water, such that the fresh washing water is supplied to the tub 10, to raise the water level of the washing water until the water level of the washing water reaches to the preset water level h1, when control unit 90 turn off the water supply valve 42 again, to stop the re-supply of the washing water (S3).

The control unit 90 repeats rotation/stop of the drum 20, and re-supply/stop of washing water alternately until the time period after starting of the initial water supply is greater than the water supply/water re-supply set time period $t_1$, and if the time period after starting of the initial water supply is greater than the water supply/water re-supply set time period $t_1$, the control unit 90 stops the repetition (S4).

The control unit 90 turns on the circulating pump 56 to circulate the washing water at the lower portion of the tub 10 to a front side of the drum 20 and spray toward the inside of the drum 20, and turns on the motor 30 to rotate the drum 20 when the washing water circulates (S6).

When the circulating pump 56 is turned on, the washing water at the lower portion of the inside of the tub 10 passes through the drain bellows tube 48, the circulating pump 56, the circulating hose 60, and the sprayer 62 in succession, and sprayed toward the inside of the drum 20, to wet the laundry 'm' uniformly, and quickly.

When the drum 20 rotates, the laundry 'm' moves inside of the drum 20, such that dirt is removed from the laundry by action with the washing water.

In the meantime, the control unit 90 compares a time period after the circulating pump 56 is turned on to a circulating set time period $t_2$ in the middle of circulation of the washing water (S7).

The control unit 90 turns off the circulating pump 56 if the time period after the circulating pump 56 is turned on is greater than a circulating set time period $t_2$ (S8).

In the drum type washing machine, the washing water circulates no more when the circulating pump 56 is turned off, to wash the laundry by rotating the drum 20 only.

The control unit 90 compares a time period after the circulating pump 56 is turned on, or the circulating pump 56 is turned off to a drum rotation set time period (for an example, 10 minutes) (S9).

The control unit 90 turns off the motor 30 to stop the drum 20 if time period after the circulating pump 56 is turned on, or the circulating pump 56 is turned off greater than a drum rotation set time period (S10).

Thereafter, the control unit 90 turns on the drain pump 54 after the turning off of the motor 30.

When the drain pump 54 is turned on, the contaminated washing water is drained to an outside of the drum type washing machine from the tub 10 through the drain bellows tube 48, the drain pump 54, and the drain hose 55, and when the draining is finished, the drain pump 54 is turned off (S11).

Thereafter, the control unit 90 determines reception of an order to perform a rinsing cycle, and if received, supplies/re-supplies the washing water like the washing cycle, rotates the drum 20, circulates the washing water only once, to rinse the laundry, and drains contaminated washing water having the laundry rinsed thereby to the outside of the drum type washing machine.

Figure 5:
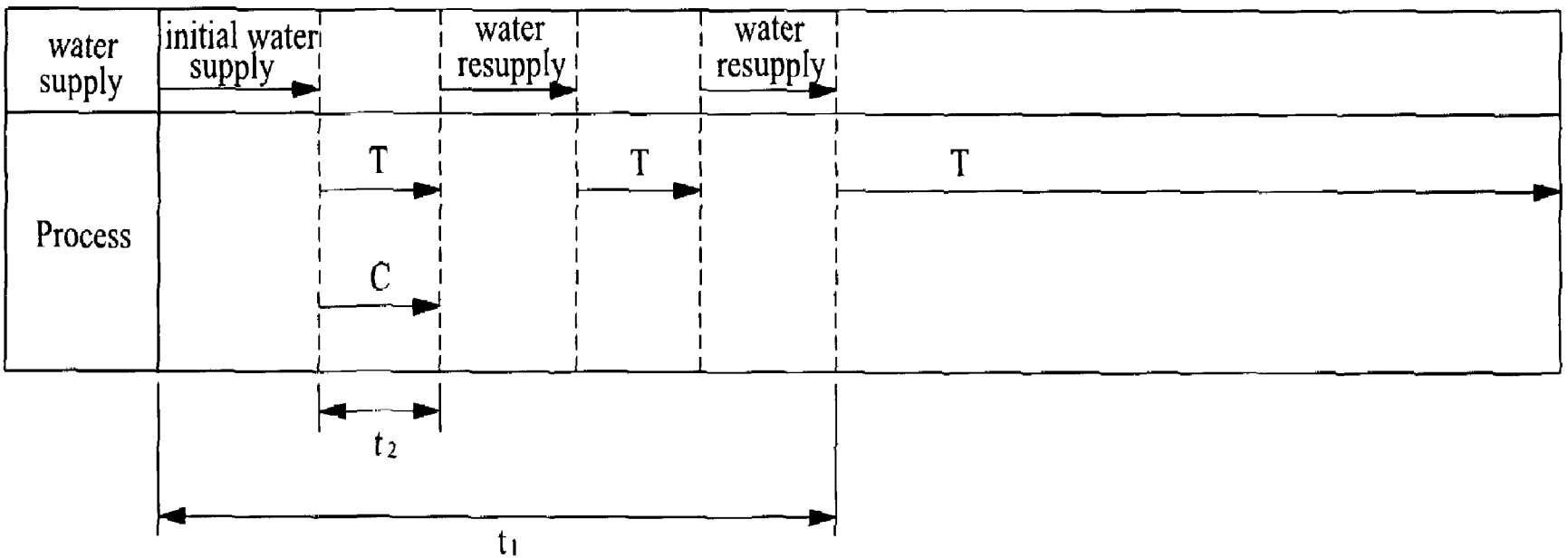
FIG. 5 illustrates a diagram showing washing water supply, drum rotation, and washing water circulation in a method for controlling a drum type washing machine in accordance with a second preferred embodiment of the present invention.
Figure 6:
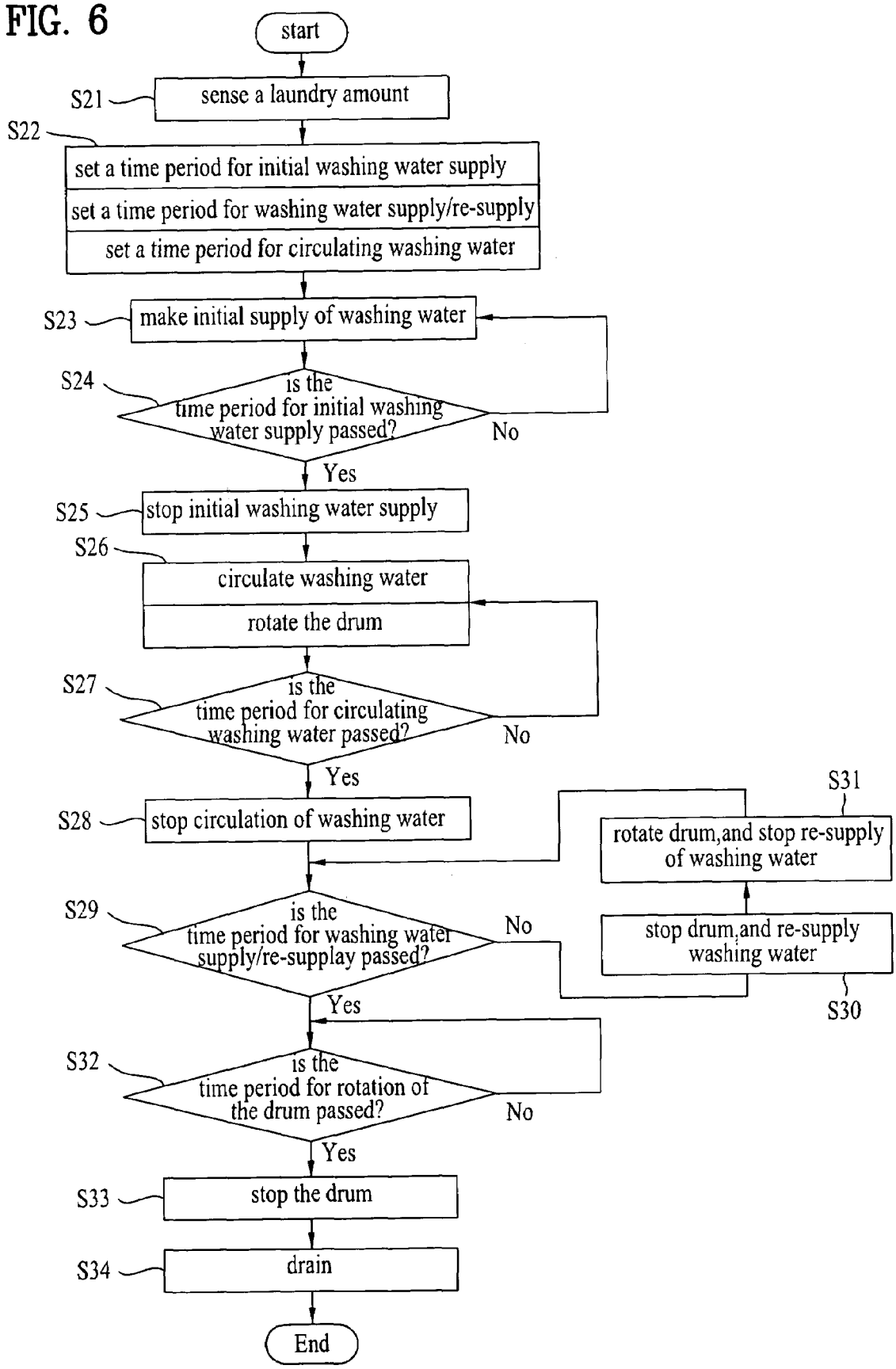
FIG. 6 illustrates a flow chart showing the steps of a method for controlling a drum type washing machine in accordance with a second preferred embodiment of the present invention.

FIG. 5 illustrates a diagram showing washing water supply, drum rotation, and washing water circulation in a method for controlling a drum type washing machine in accordance with a second preferred embodiment of the present invention, and FIG. 6 illustrates a flow chart showing the steps of a method for controlling a drum type washing machine in accordance with a second preferred embodiment of the present invention.

In the method for controlling a drum type washing machine in accordance with a second preferred embodiment of the present invention, referring to FIG. 6, if an order to perform a washing cycle is received, the control unit 90 senses a laundry amount (S21).

Since the sensing of the laundry amount is the same with the method for controlling a drum type washing machine in accordance with a first preferred embodiment of the present invention, detailed description of which will be omitted.

Thereafter, the control unit 90 sets an amount of initial water supply with reference to the sensed laundry amount (S22).

The setting of the initial water supply amount is set as an initial water supply time period. If the laundry amount is great, the initial water supply time period is set to be long (for an example, 1 minute), and if the laundry amount is small, the initial water supply time period is set to be short (for an example, 30 seconds).

Along with this, the control unit 90 sets the water supply/water re-supply set time period '$t_1$' with reference to the sensed laundry amount, and the circulating set time period $t_2$ with reference to the sensed laundry amount (S22).

Since the setting of the water supply/water re-supply set time period '$t_1$' and the circulating set time period $t_2$ is the same with the method for controlling a drum type washing machine in accordance with the first preferred embodiment of the present invention, detailed description of which will be omitted.

The control unit 90 turns on the water supply valve 42, to make an initial water supply (S23).

When the water supply valve 42 is turned on, the washing water is supplied to a lower portion of an inside of the tub 10, and flows into an inside of the drum 20 through the water holes 22 in the drum 20, to wet the laundry 'm'.

The control unit 90 compares a time period after the water supply valve 42 is turned on to the initial water supply time period (S24).

The control unit 90 turns off the water supply valve 42 to stop the initial supply of the washing water if the time period after the water supply valve 42 is turned on reaches to the initial water supply time period, i.e., if the washing water is supplied as much as the preset initial water supply amount (S25).

Then, the control unit 90 turns on the circulating pump 56 so that the washing water at the lower portion of the inside of the tub 10 circulates to a front side of the drum 20, and sprayed toward the inside of the drum 20, and turns on the motor 30 to rotate the drum 20 when the washing water is circulated (S26).

When the circulating pump 56 is turned on, the washing water at the lower portion of the inside of the tub 10 passes through the drain bellows tube 48, the circulating pump 56, the circulating hose 60, and the sprayer 62 in succession, and sprayed into the inside of the drum 20, to wet the laundry 'm' uniformly and quickly, and, while an amount of the washing water wetting the laundry becomes the greater as time goes by gradually, the water level of the washing water at the lower portion of the inside of the tub 20 becomes the lower, gradually.

When the drum 20 rotates, the laundry 'm' moves inside of the drum 20, and wet with the washing water sprayed into the drum 20 uniformly, such that dirt is removed from the laundry by action with the washing water.

In the meantime, the control unit 90 compares a time period after the circulating pump 56 is turned on to a circulating set time period $t_2$ in the middle of circulation of the washing water (S27).

The control unit 90 turns off the circulating pump 56 if the time period after the circulating pump 56 is turned on is greater than a circulating set time period $t_2$ (S28).

Then, the control unit 90 compares the time period after the starting of the initial water supply to the water supply/water re-supply set time period $t_1$ (S29).

The control unit 90 turns off the motor 30 to stop the drum 20, and turns on the water supply valve 42 again to re-supply fresh washing water (S30) if the time period after the starting of initial water supply is less than the water supply/water re-supply set time period '$t_1$' (S30).

As the water supply valve 42 is turned on again, fresh washing water is supplied to the tub 10, to raise the water level of the washing water, until the water level reaches to a preset water level $h_1$ when the water supply valve 42 is turned off again, to stop the re-supply of the washing water.

In this instance, since the turning off of the water supply valve 42 following the reach of the water level to the present water level $h_1$ is the same with the method for controlling a drum type washing machine in accordance with the first preferred embodiment of the present invention, detailed description of which will be omitted.

The control unit 90 turns on the motor 30 to rotate the motor 30 at the same time with turning off of the water supply valve 42 (S31).

Thereafter, the control unit 30 compares the time period after starting of the initial water supply to the water supply/water re-supply set time period $t_1$ again if the motor 30 is turned on for the preset time period of the motor 30 (for an example, 30 seconds), or if the water level of the washing water at the lower portion of the inside of the tub 10 is lower than a second set water level ($h_2$, $h_2<h_1$).

The control unit 30 repeats rotation/stop of the drum 20 and re-supply/stop of washing water, and rotation of the drum 20 and finish of re-supply of the washing water if the time period after starting of the initial water supply fails to reach to the water supply/water re-supply set time period $t_1$, and if the time period after starting of the initial water supply is greater than the water supply/water re-supply set time period $t_1$, the control unit 90 stops the repetition (S4).

The control unit 90 performs the re-supply of washing water no more, but maintains the rotation of the drum 20, if the time period after starting of the initial water supply is greater than the water supply/water re-supply set time period $t_1$.

In the meantime, the control unit 90 compares a time period after finish of the re-supply of the washing water or a time period after starting of rotation of the drum 20 finally to a drum rotation set time period (S32).

The control unit turns off the motor 30 to stop the drum 20 if the time period after finish of the re-supply of the washing water or the time period after starting of rotation of the drum 20 finally is greater than a drum rotation set time period (S33).

Thereafter, the control unit 90 turns on the drain pump 54 after turning off the motor 30.

When the drain pump 54 is turned on, the contaminated washing water is drained from the tub 10 to an outside of the drum type washing machine through the drain bellows 48, the drain pump 54, and the drain hose 55, and if the draining is finished, the drain pump 54 is turned off (S34).

Then, the control unit 90 determines if an order to perform a rinsing cycle is received. If the order to perform a rinsing cycle is selected, alike the washing cycle, the control unit 90 makes an initial supply of the washing water for an initial waster supply time period on the laundry amount, and after the initial water supply is finished, circulates the washing water only once, and performs control thereafter.

Figure 7:
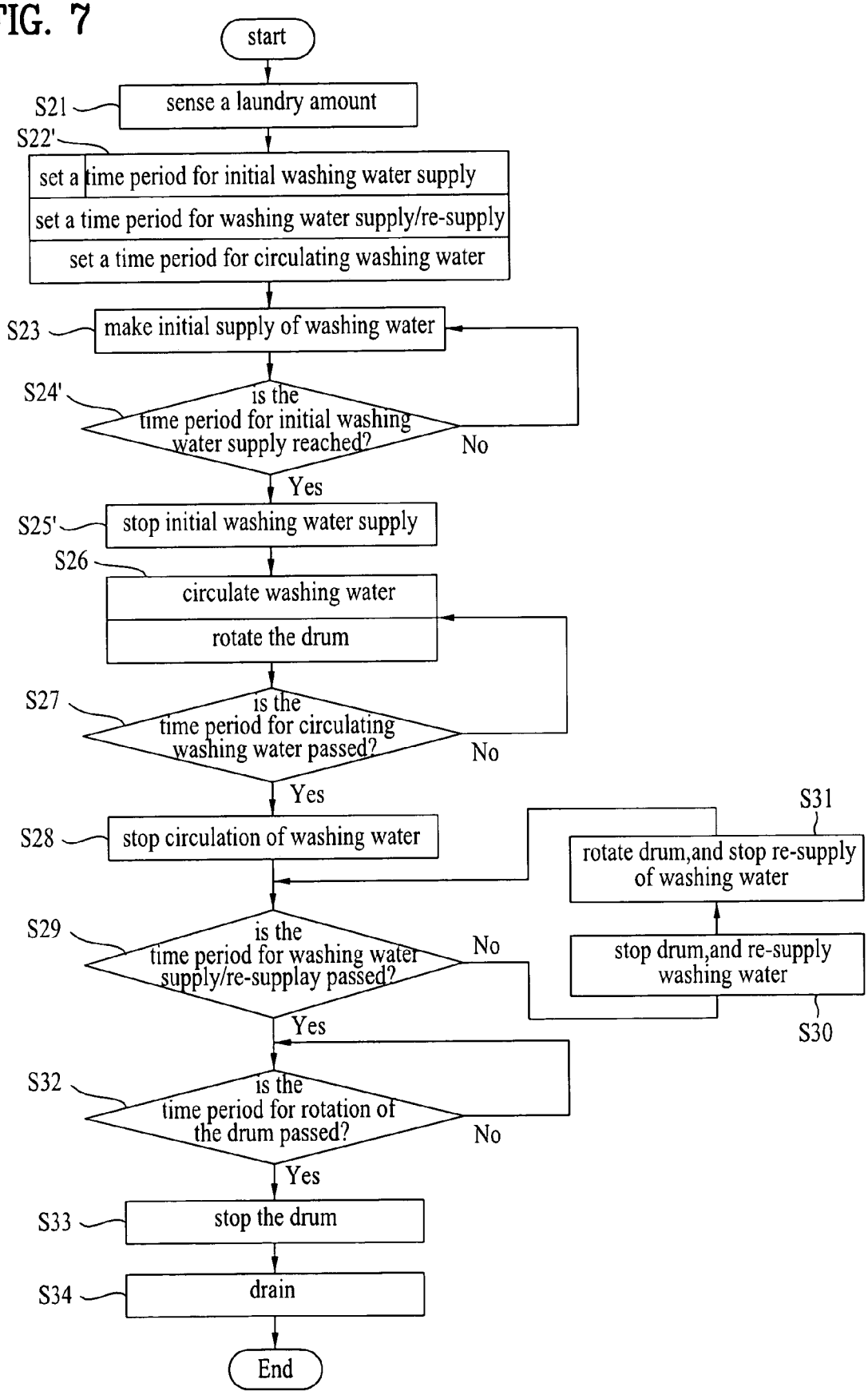
FIG. 7 illustrates a flow chart showing the steps of a method for controlling a drum type washing machine in accordance with a third preferred embodiment of the present invention.

FIG. 7 illustrates a flow chart showing the steps of a method for controlling a drum type washing machine in accordance with a third preferred embodiment of the present invention.

Referring to FIG. 7, in the method for controlling a drum type washing machine in accordance with a third preferred embodiment of the present invention, if an initial water supply amount is set as an initial water supply level S22', and a water level of the washing water after the water supply valve 42 is turned on reaches to the initial water supply level, the water supply valve 42 is turned off, to stop the initial water supply S24', and S25'. Since other controls except the performance of the initial water supply to the initial water supply level is the same with the third preferred embodiment of the present invention, detailed description of which will be omitted.

In the method for controlling a drum type washing machine of the embodiment, if the laundry amount sensed is great, the water level of the initial water supply is set high, and if the laundry amount sensed is small, the water level of the initial water supply is set low relatively.

Figure 8:
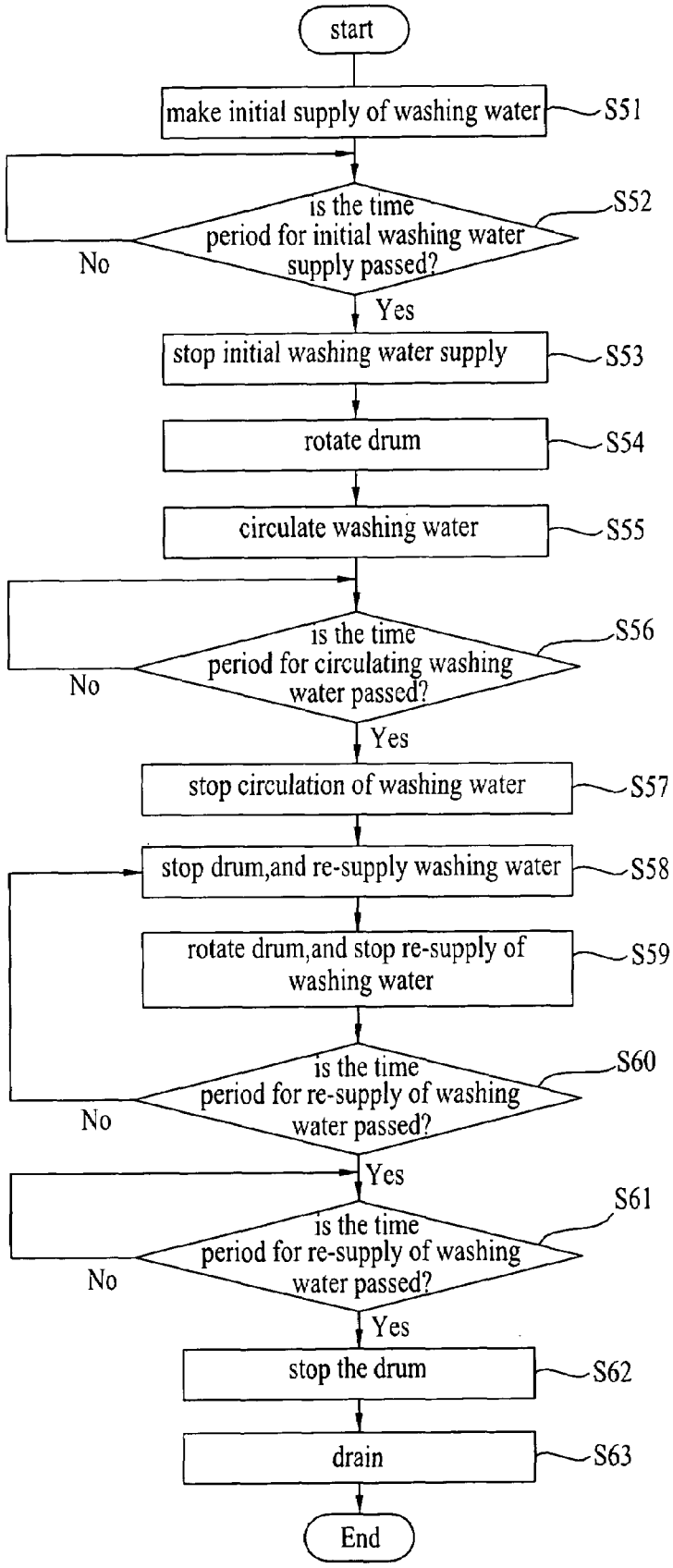
FIG. 8 illustrates a flow chart showing the steps of a method for controlling a drum type washing machine in accordance with a fourth preferred embodiment of the present invention.

FIG. 8 illustrates a flow chart showing the steps of a method for controlling a drum type washing machine in accordance with a fourth preferred embodiment of the present invention.

Referring to FIG. 8, if a washing cycle is selected, the control unit turns on a water supply valve 42, to perform initial water supply (S51).

The turning on, and a subsequent operation thereof is identical to the first, or third embodiment of the present invention, of which detailed description will be omitted.

The control unit 90 compares a time period after turning on the water supply valve 42 to an initial water supply setting time period (for an example, 2 minutes) (S52).

If the time period after turning on the water supply valve 42 reaches to the initial water supply setting time period, the control unit 90 turns off the water supply valve 42 to stop the initial water supply (S53).

Then, the control unit 90 turns on the motor 30 to rotate the drum 20 (S54).

When the drum 20 rotates, the laundry 'm' circulates inside of the drum 20 and has dirt removed therefrom by action of the washing water.

Along with this, the control unit 90 turns on the circulating pump 56 so that the washing water circulates from a lower portion of an inside of the tub 10 to a front side of the drum 20, and is sprayed toward the inside of the drum 20 (S55).

When the circulating pump 56 is turned on, the washing water at the lower portion of an inside of the tub 10 passes through the drain bellows tube 48, the circulating pump 56, the circulating hose 60, and the sprayer 62 in succession, and is sprayed toward the inside of the drum 20, to wet the laundry 'm' uniformly, and quickly, such that, as time goes by, a quantity of the washing water wet to the laundry increase gradually, to drop the water level of the washing water at the lower portion of the inside of the tub 20 gradually.

In the middle of circulation of the washing water thus, the control unit 90 compares a time period after the circulating pump 56 is turned on to a washing water circulation set time period (for an example, 2 minutes) (S56).

If the time period after the circulating pump 56 is turned on reaches to the washing water circulation set time period, the control unit 90 turns off the circulating pump 56, to stop the circulation of the washing water (S57).

Then, the control unit 90 turns off the motor 30 to stop the drum 20, and turns on the water supply valve 42 again for re-supplying fresh washing water (S58).

As the water supply valve 42 is turned on again, fresh washing water is supplied to the tub 10, to raise the water level of the washing water again.

In the meantime, if the water level of the washing water rising by the re-supply of the washing water reaches to the set water level $h_1$, the control unit 90 turns off the water supply valve 42 again to stop the re-supply of the washing water.

In this instance, since the turning off of the water supply valve 42 following the reaching to the set water level $h_1$ is identical to the method for controlling a drum type washing machine in accordance with the first preferred embodiment of the present invention, detailed description of which will be omitted.

The control unit 90 turns on the motor 30 to rotate the drum 20 at the same time with the turning off of the water supply valve 42 (S59).

Thereafter, if the motor 30 is turned on for the set time period (for an example, 30 seconds), or the water level of the washing water at the lower portion of the inside of the tub 10 is lower than the second set water level ($h_2$, $h_2<h_1$), a time period after initial starting of the re-supply of the washing water is compared to a washing water re-supply set time period (for an example, 5 minutes) (S60).

If the time period after initial starting of the re-supply of the washing water does not reach to a washing water re-supply set time period, the control unit 90 repeats rotation of the drum 20 and re-supply of the washing water, and, if the time period after initial starting of the re-supply of the washing water is greater than a washing water re-supply set time period (for an example 5 minutes), the control unit 90 stops the repetition.

That is, if the time period after initial starting of the washing water supply is greater than the washing water supply/re-supply set time period $t_1$, the control unit 90 performs the re-supply of the washing water no more, and but maintains the rotation of the drum 20.

In the meantime, if a time period after finishing the re-supply of the washing water or a time period after last time starting of the rotation of the drum 20 is greater than a drum rotation set time period, the control unit 90 turns off the motor 30 to stop the drum 20 (S61, and S62).

Then, the control unit 90 turns on the drain pump 54 after turning off the motor 30.

When the drain pump 54 is turned on, the contaminated washing water is drained from the tub 10 to an outside of the drum type washing machine through the drain bellows 48, the drain pump 54, and the drain hose 55, and when the draining is finished, the drain pump 54 is turned off (S63).

Then, the control unit 90 determines whether an order to performing a rinsing cycle is received or not. If received, alike the washing cycle, the control unit 90 performs an initial water supply for the initial water supply set time period, circulates the washing water only once after finish of the initial water supply, and carries out control required thereafter.

Figure 9:
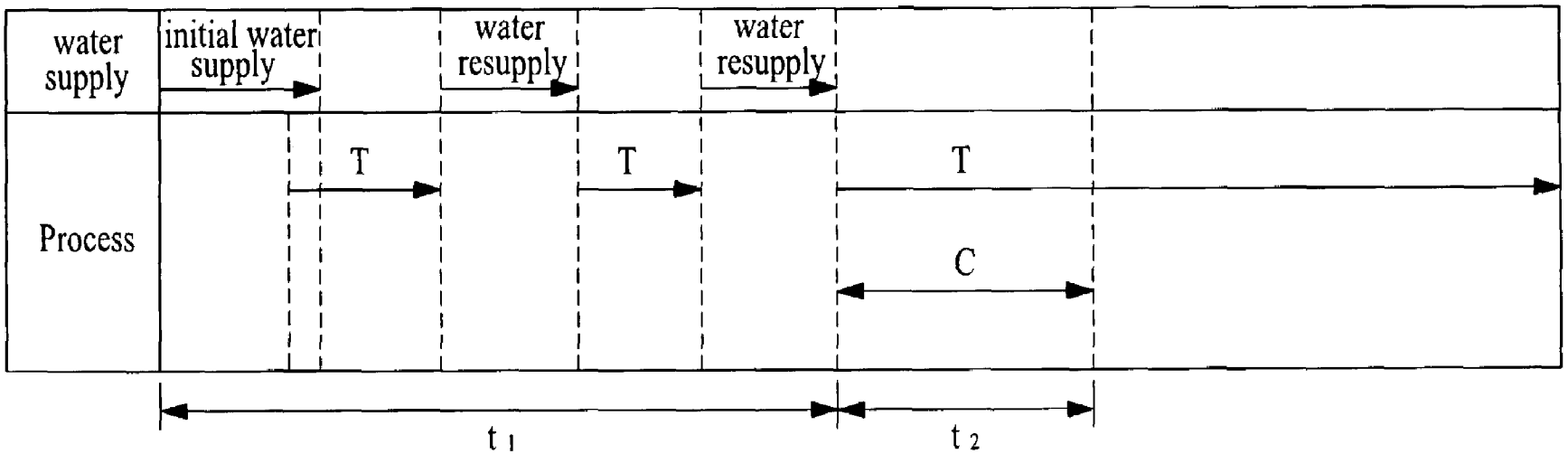
FIG. 9 illustrates a flow chart showing the steps of a method for controlling a drum type washing machine in accordance with a fifth preferred embodiment of the present invention.

FIG. 9 illustrates a flow chart showing the steps of a method for controlling a drum type washing machine in accordance with a fifth preferred embodiment of the present invention.

Referring to FIG. 9, the method for controlling a drum type washing machine in accordance with the fifth embodiment of the present invention rotates the drum 20 between a last stage of the initial water supply and the re-supply of washing water, except which the method for controlling a drum type washing machine in accordance with the fifth embodiment of the present invention is identical to one of the first to fourth embodiments of the present invention, of which detailed description will be omitted.

If the water level of the washing water supplied initially reaches to a third set water level $h_3$ which is set lower than the set water level $h_1$ at which the initial water supply is finished, the control unit 90 turns on the motor 30 to rotate the drum 20.

That is, at the last stage of the initial water supply, the washing water supply and the rotation of the drum 20 are performed at the same time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

The only one time of washing water circulation after washing water supply/re-supply, or at least initial washing water supply according to a laundry amount permits to shorten a total washing time period, and improve lifetimes and reliability of electric components, such as the circulating pump.

Moreover, the washing water supply/re-supply for a preset time period according to a laundry amount permits to minimize a quantity of the washing water, and to obtain an optimum washing performance.

Furthermore, the conduction of the circulation of the washing water for a preset time period according to the laundry amount permits to obtain an optimum washing performance.

The invention claimed is:

1. A method for controlling a washing machine comprising the steps of:

sensing a laundry amount;

supplying washing water a plurality of times to a tub of the washing machine to maintain a preset level, the supplying washing water step including:

initially supplying the washing water to the tub to the preset level and stopping the initial supply of water after reaching the preset level; and resupplying the washing water a plurality of times to the tub to maintain the preset level after the initial supplying step, each time stopping the supply of water after reaching the preset level; and circulating the washing water for a predetermined time period for wetting the laundry;

setting a total time period of the supplying steps according to the sensed laundry amount before the supplying steps; and setting a time period for the circulating step according to the sensed laundry amount before the circulating step.

2. The method as claimed in claim 1, wherein the step of circulating the washing water is performed after all the steps of supplying the washing water is finished.

3. The method as claimed in claim 1, wherein the step of circulating washing water is performed after the step of initial supply of washing water is finished.

4. The method as claimed in claim 3, further comprising the step of determining a quantity of washing water to be supplied during the step of initial supply of washing water according to the laundry amount sensed before the step of supplying washing water.

5. The method as claimed in claim 4, wherein the step of determining a quantity of washing water includes the step of setting a total time period of the step of initial supply of washing water.

6. The method as claimed in claim 4, wherein the step of determining a quantity of washing water includes the step of setting a water level to be reached in the step of initial supply of washing water.

7. The method as claimed in claim 1, further comprising the steps of rotating a drum of the washing machine between each of the initial supplying step and the resupplying steps.

8. The method as claimed in claim 7, wherein each of the resupplying steps is performed after each of the rotating steps.

9. The method as claimed in claim 1, further comprising rotating a drum of the washing machine after finish of the step of supplying washing water.

10. The method as claimed in claim 1, further comprising rotating a drum of the washing machine during the step of circulating washing water.

11. The method as claimed in claim 1, wherein each of the resupplying steps is performed when the water level is lower than a second preset level which is set to be lower than the preset level.

* * * * *